US007178716B2

(12) United States Patent
Yong

(10) Patent No.: US 7,178,716 B2
(45) Date of Patent: Feb. 20, 2007

(54) CONCEALED LATCH HANDLE MULTI-POINT LOCKING MAILBOX

(75) Inventor: Teng-Long Yong, Singapore (SG)

(73) Assignee: 2B Global, Inc., Newport Beach, CA (US)

( * ) Notice: Subject to any disclaimer, the term of this patent is extended or adjusted under 35 U.S.C. 154(b) by 0 days.

(21) Appl. No.: 11/125,522

(22) Filed: May 10, 2005

(65) Prior Publication Data

US 2006/0255116 A1 Nov. 16, 2006

(51) Int. Cl.
*B65G 11/04* (2006.01)

(52) U.S. Cl. ..... 232/45; 232/24; 312/217; 312/218; 292/40; 292/36

(58) Field of Classification Search ..... 232/24, 232/25, 17, 45; 312/216–218, 292, 204, 312/324; 292/40, 36, 167, 173, 42; 49/367
See application file for complete search history.

(56) References Cited

U.S. PATENT DOCUMENTS

| | | | | |
|---|---|---|---|---|
| 5,794,844 | A * | 8/1998 | Jenkins | 232/25 |
| 6,247,641 | B1 * | 6/2001 | Noblet et al. | 232/17 |
| 6,296,181 | B1 * | 10/2001 | Noblet et al. | 232/45 |
| 6,328,205 | B1 * | 12/2001 | Noblet et al. | 232/17 |
| 6,729,701 | B2 * | 5/2004 | Carter et al. | 312/222 |

* cited by examiner

*Primary Examiner*—William L. Miller
(74) *Attorney, Agent, or Firm*—Lewis Brisbois Bisgaard & Smith LLP; Jon E. Hokanson

(57) ABSTRACT

A latch assembly of the type used on postal cluster units, such as central mailbox units including a latch assembly of multiple dual bold latch mechanisms for securing at multiple latch points a pair of center meeting hinged doors upon closure of the doors. The dual bolt latch mechanisms of the latch assembly are enclosed within the cabinet of the postal cluster unit and are operable by a single concealed handle to simultaneously unlatch the multiple latch points.

3 Claims, 8 Drawing Sheets

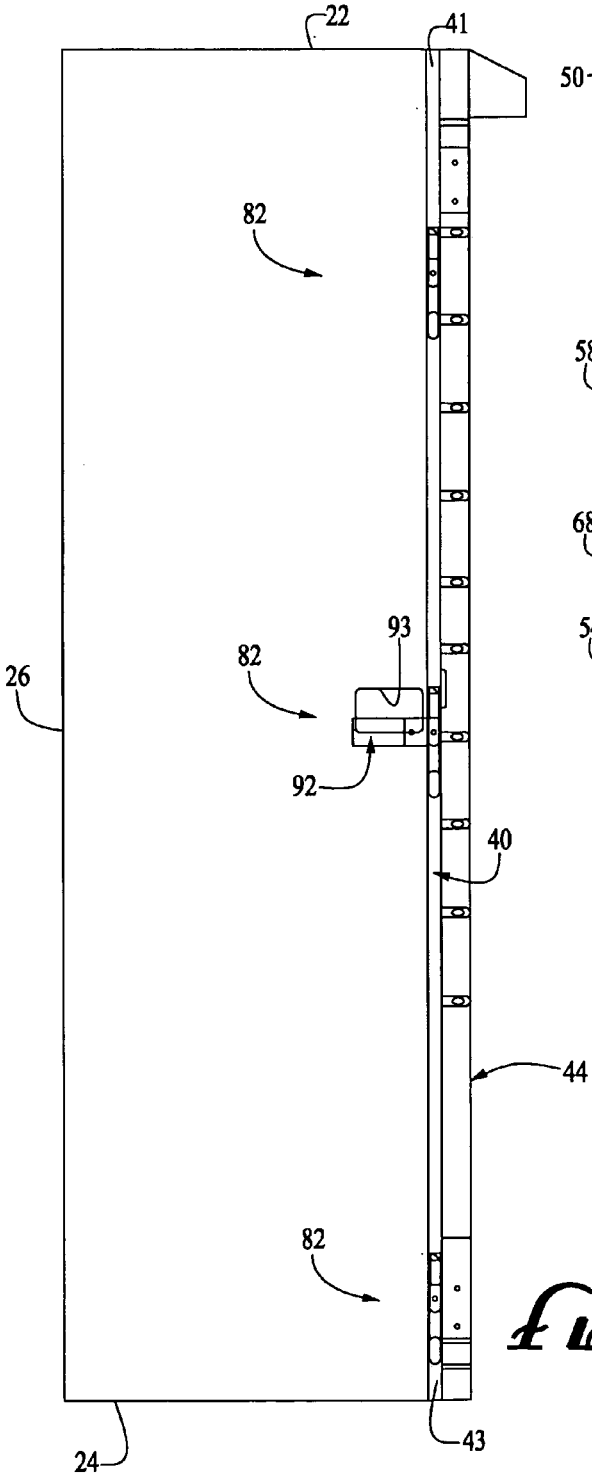
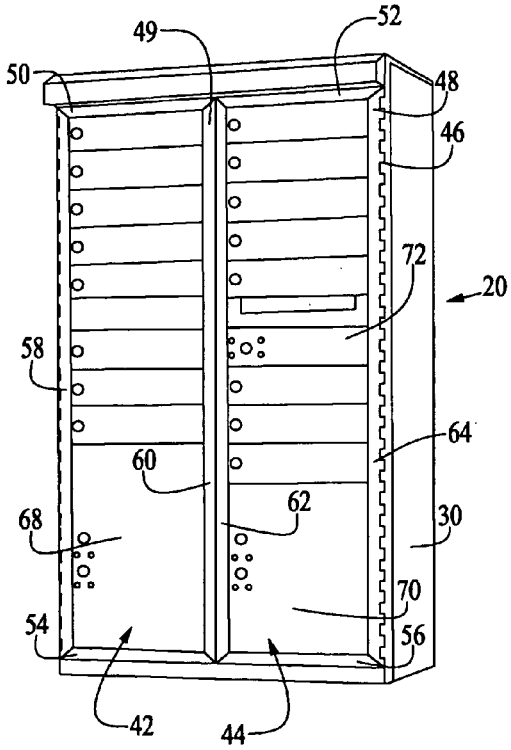
FIG. 2
FIG. 3

CONCEALED LATCH HANDLE MULTI-POINT LOCKING MAILBOX

FIELD OF INVENTION

The present invention is directed to a mailbox including a latch mechanism or assembly of the type commonly used on postal box cluster units, including central mailbox units, and on commercial cabinets and cases, and the like. The present invention provides a mailbox with a door latch mechanism or assembly for retaining multiple sets of spring urged linearly operable bolt members securely by corresponding multiple sets of bolt receiver members that is operable by a handle assembly contained within the unit or cabinet.

Conventional locks and latch assemblies of the kind commonly used in the above described applications have exhibited a number of problems and drawbacks which the present invention is intended to improve upon. These problems and drawbacks include the use of many parts and often complicated combinations of motions between the parts to provide open and closed latch positions thereby tending to increase the complexity and cost of the manufacturing process. Additionally, conventional locking assemblies often have handles that are inconvenient or difficult to operate and components that may present protruding surfaces and/or sharp edges that are subject to being bend or broken resulting in difficult operation or malfunction. Also, conventional locking assemblies also often leave a space or gap between the door and frame, or between two center meeting doors, that may provide access for insertion of a tool to defeat the latch and force the door open. Moreover, conventional locking assemblies also often affirmatively latch only one of a pair of doors, thereby providing a less secure latching than if both doors are affirmatively latched. Often in conventional locking assemblies the latching function is accomplished by components of relatively light construction and relatively low mechanical strength, such as capture of a latch plate behind an "L" shaped catch member both of which are fabricated of relatively light gauge sheet material.

SUMMARY

Latch assemblies or mechanisms of the type commonly used on postal box cluster units or in other commercial applications as referenced above and the like are well known. Examples of such locks or latch assemblies include those described in U.S. Pat. Nos. 6,328,205; 6,247,641; 6,296,181 and 5,794,844.

A general description of the novel multi-point locking mechanism or assembly of the present invention follows. A latch mechanism or assembly for releasably securing multiple closure members, or bolts, in corresponding door mounted receiver members by means of a single protected internally mounted handle is provided. The multiple spring urged linear latch bolts are operable by simple translation of a single handle to open or unlatch the mechanism, and the mechanism is automatically securely latched by simply sequentially closing the doors of the postal box cluster unit.

BRIEF DESCRIPTION OF THE DRAWINGS

FIG. 2 is a front perspective view of a typical postal box cluster unit having two center meeting doors depicting the FIG. 1 embodiment with closed doors.

FIG. 3 is a cross-sectional side view of the FIG. 2 unit taken along its vertical front to back centerline depicting an installation of the FIG. 1 embodiment.

DETAILED DESCRIPTION OF PREFERRED EMBODIMENTS

Preferred Embodiment of the Latch Mechanism

Figure 1:
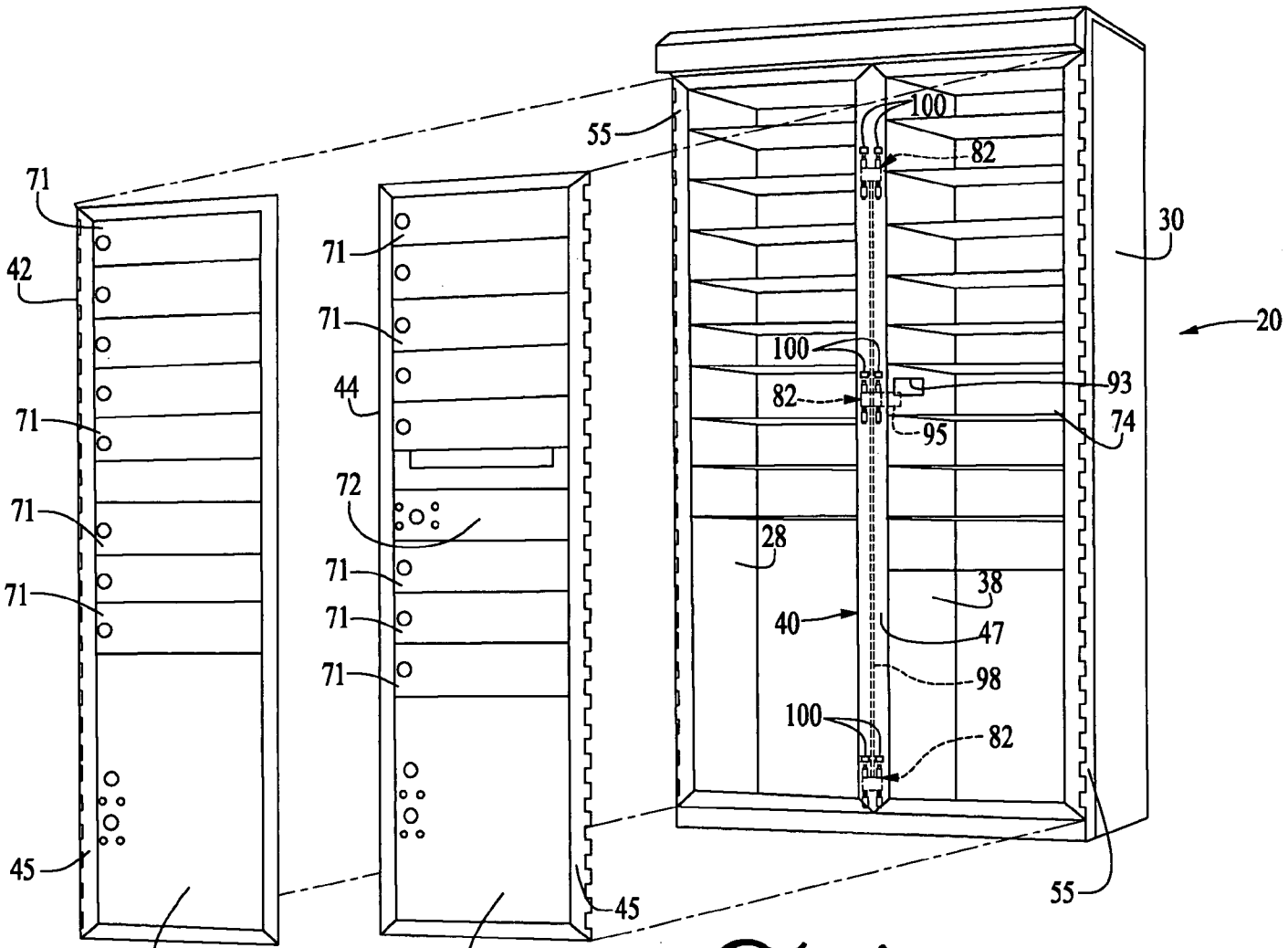
FIG. 1 is a front exploded perspective view of a typical postal box cluster unit depicting a preferred embodiment of the multi-point latching mechanism of the present invention.
Figure 4:
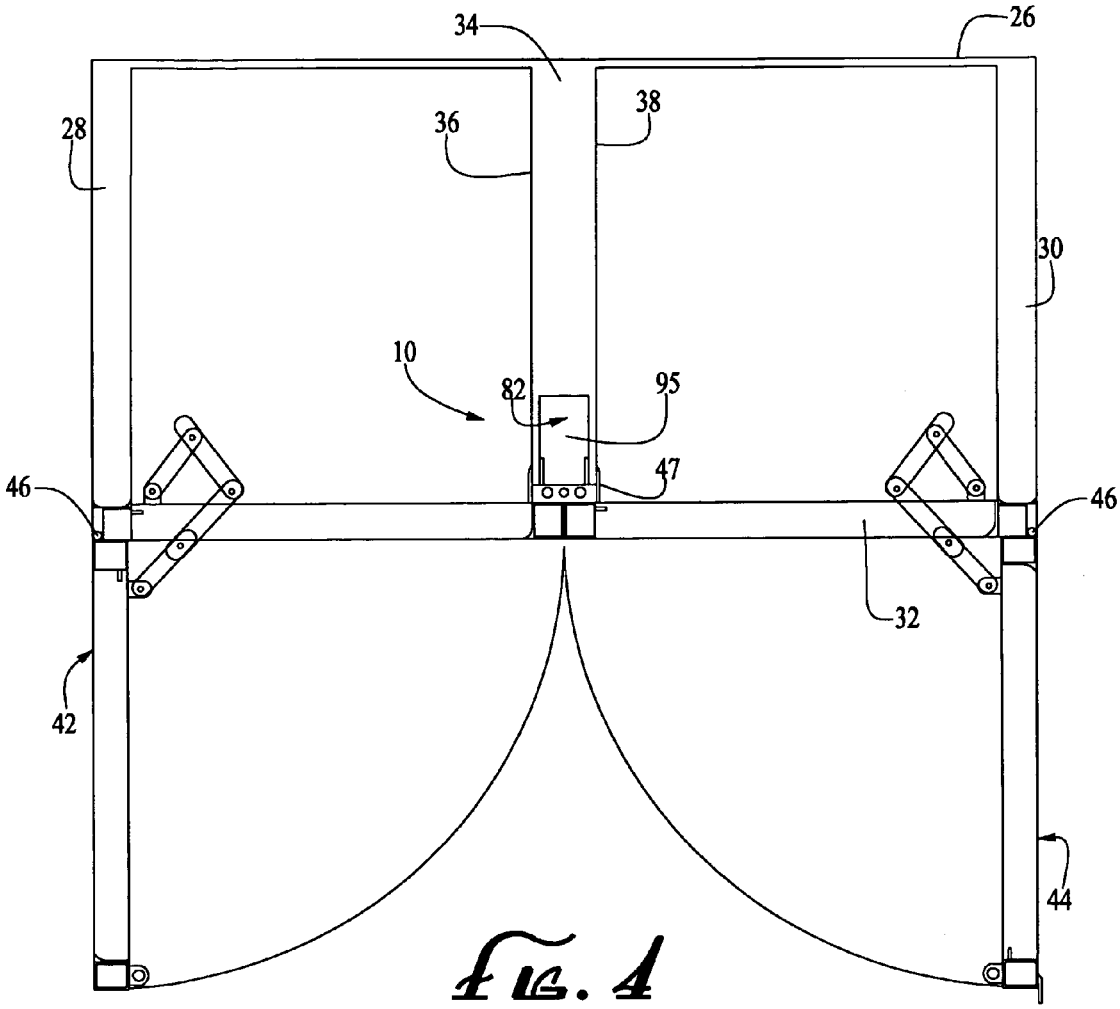
FIG. 4 is a cross-sectional top view of the FIG. 2 unit taken along its horizontal front to back centerline depicting the installation of the FIG. 1 embodiment with the two center meeting doors in their open and closed positions.
Figure 5:
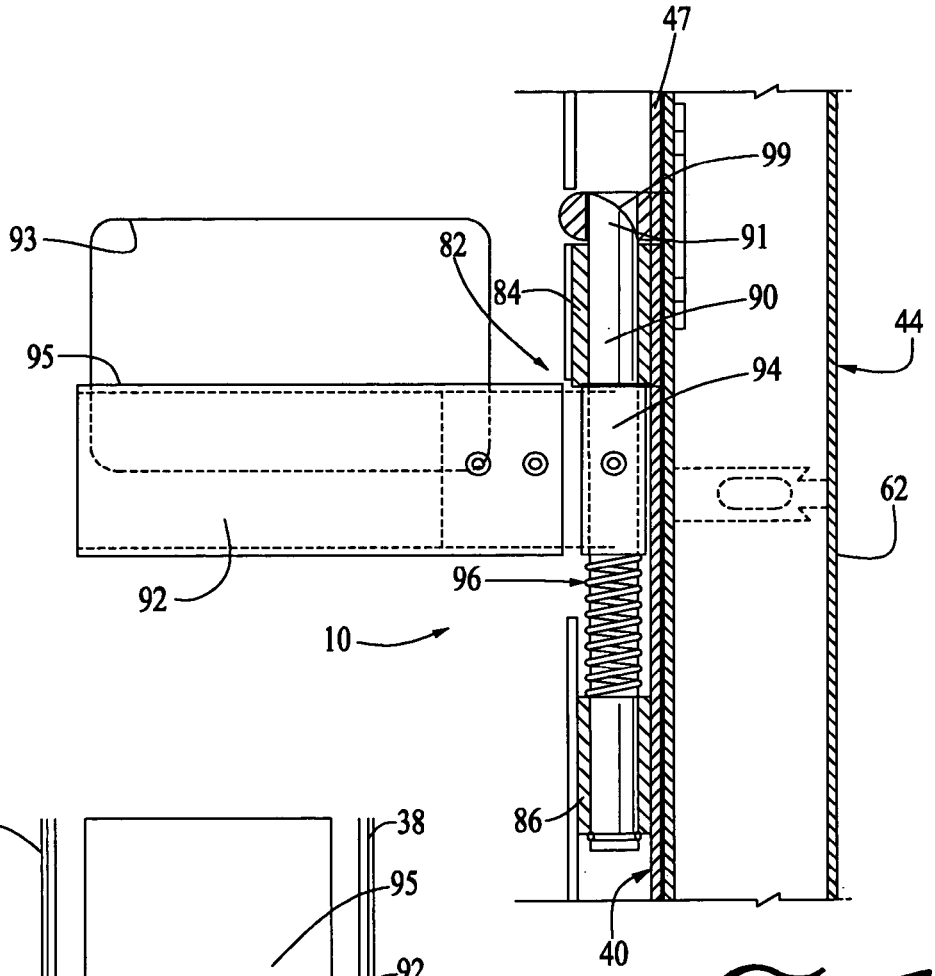
FIG. 5 is a side cross-sectional view of a detail of the FIG. 1 embodiment handle and latch bolt mechanism in the latched position.
Figure 7:
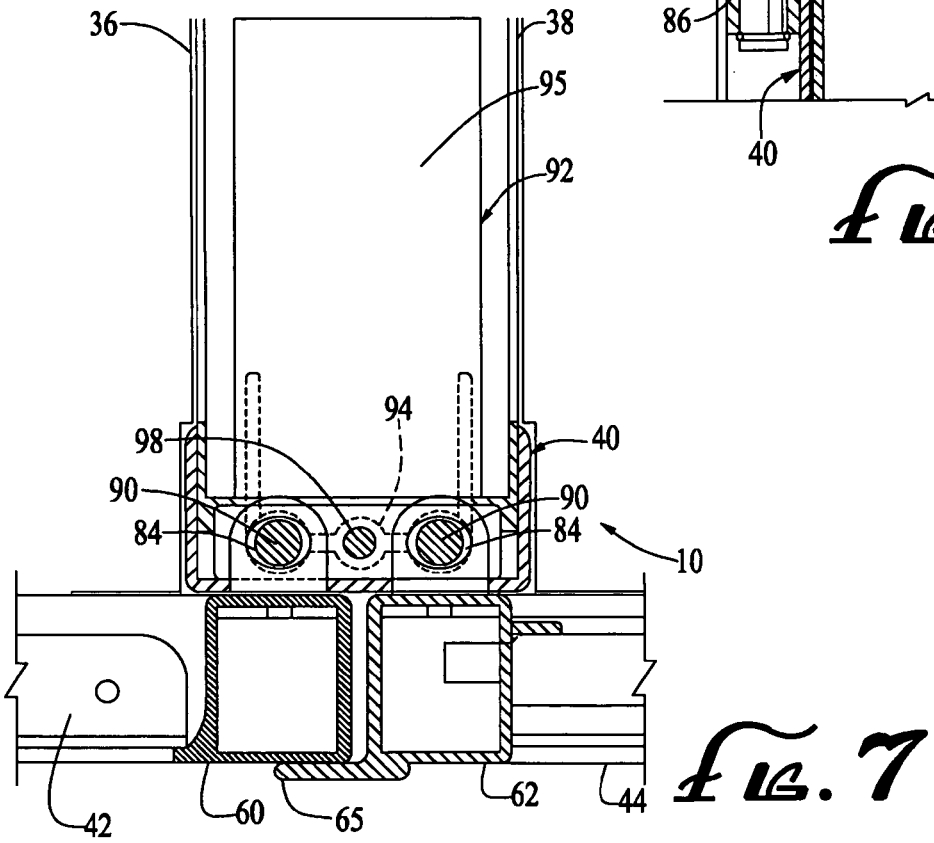
FIG. 7 is a top cross-sectional view of the FIG. 1 embodiment handle and latch bolt mechanism in the latched position.
Figure 6:
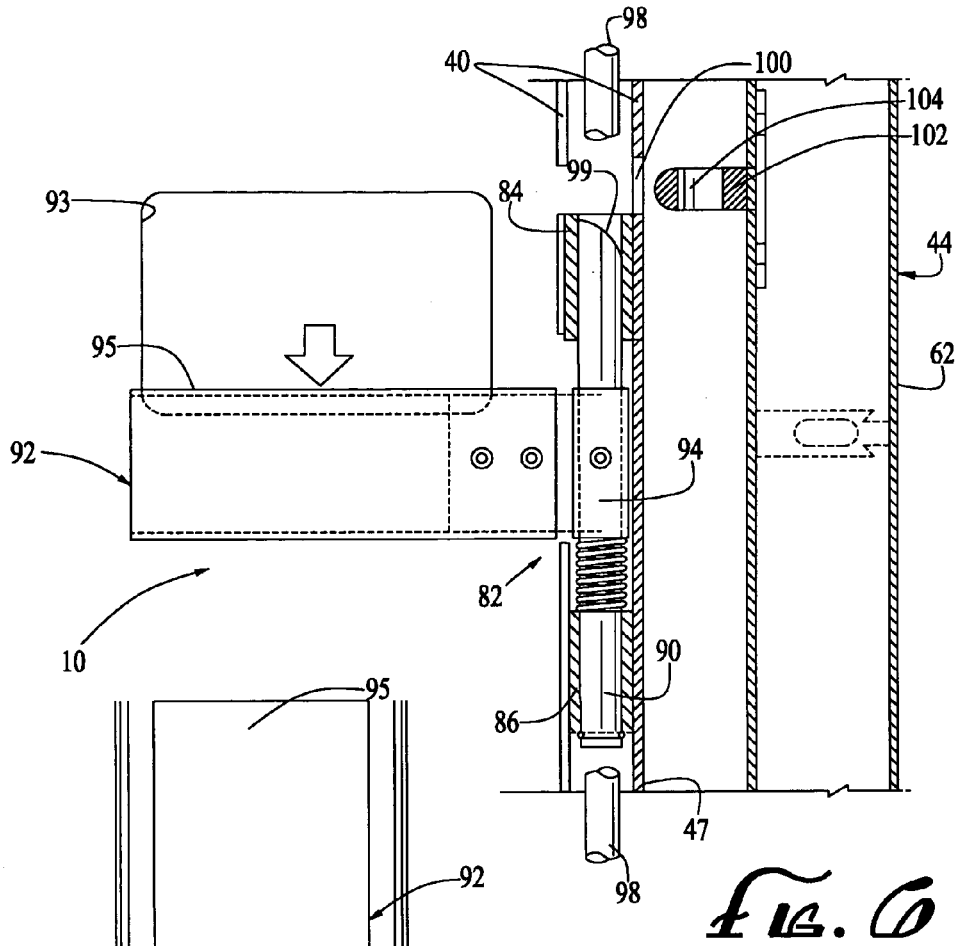
FIG. 6 is a side cross-sectional view of a detail of the FIG. 1 embodiment handle and latch bolt mechanism in the unlatched position.
Figure 8:
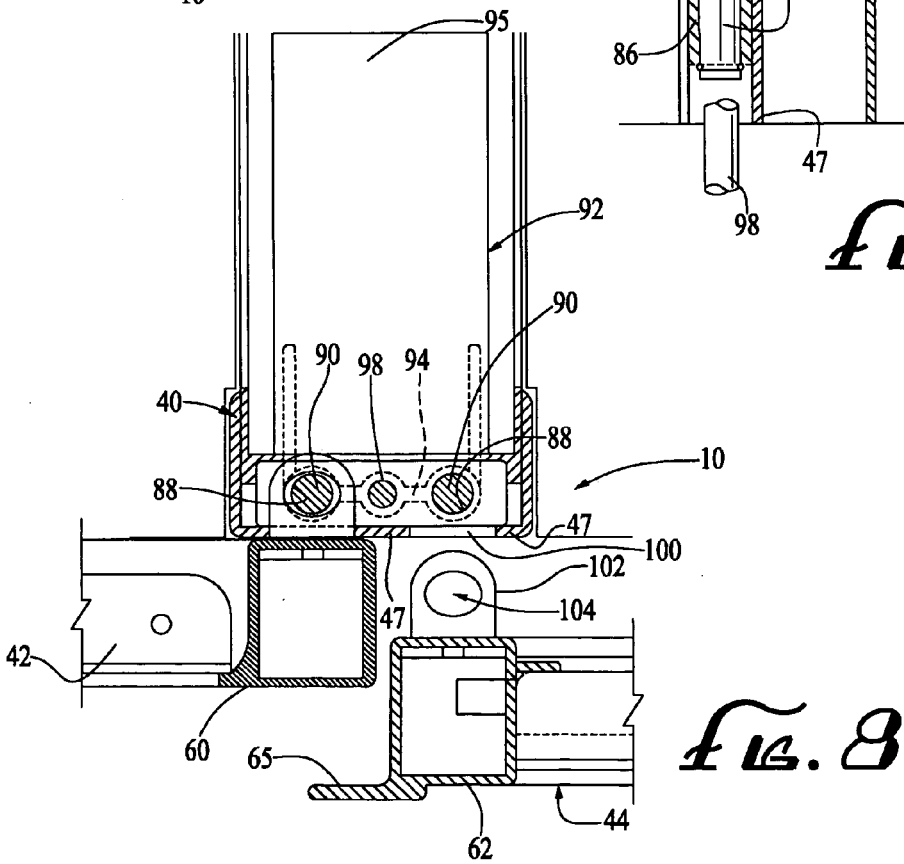
FIG. 8 is a top cross-sectional view of the FIG. 1 embodiment handle and latch bolt mechanism in the unlatched position.
Figure 9:
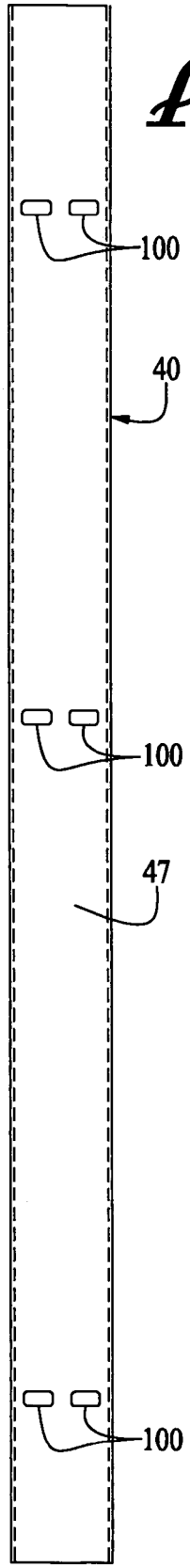
FIG. 9 is a front view of the handle and a latch bolt mechanism depicting the center channel front wall.
Figure 10:
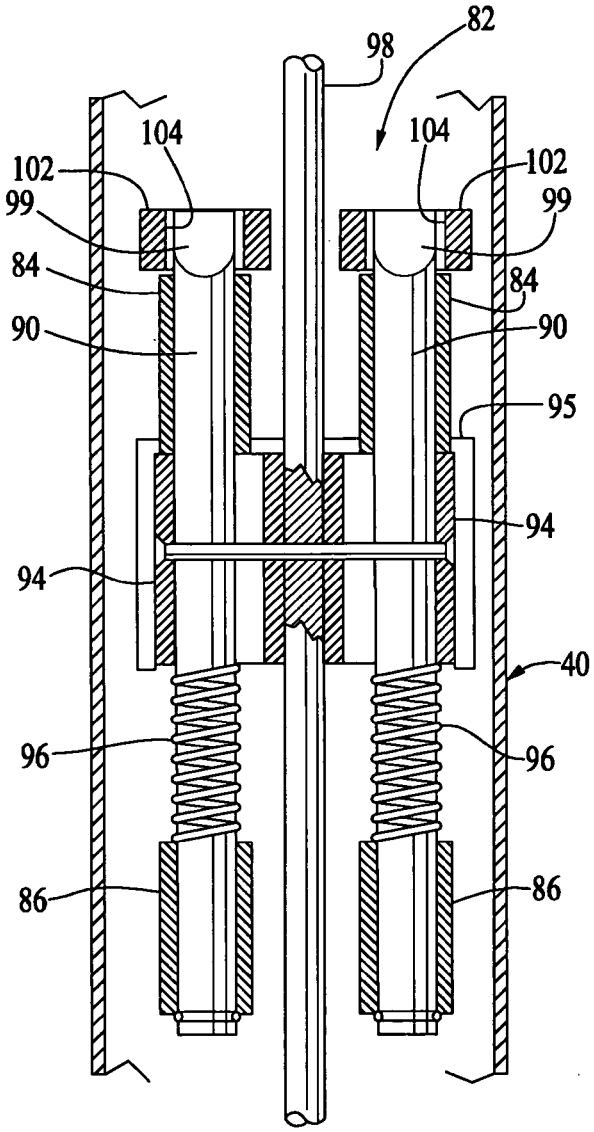
FIG. 10 is a front cross-sectional view of the handle and a latch bolt mechanism cut in the plane containing the axis of two dual bolts.
Figure 11:
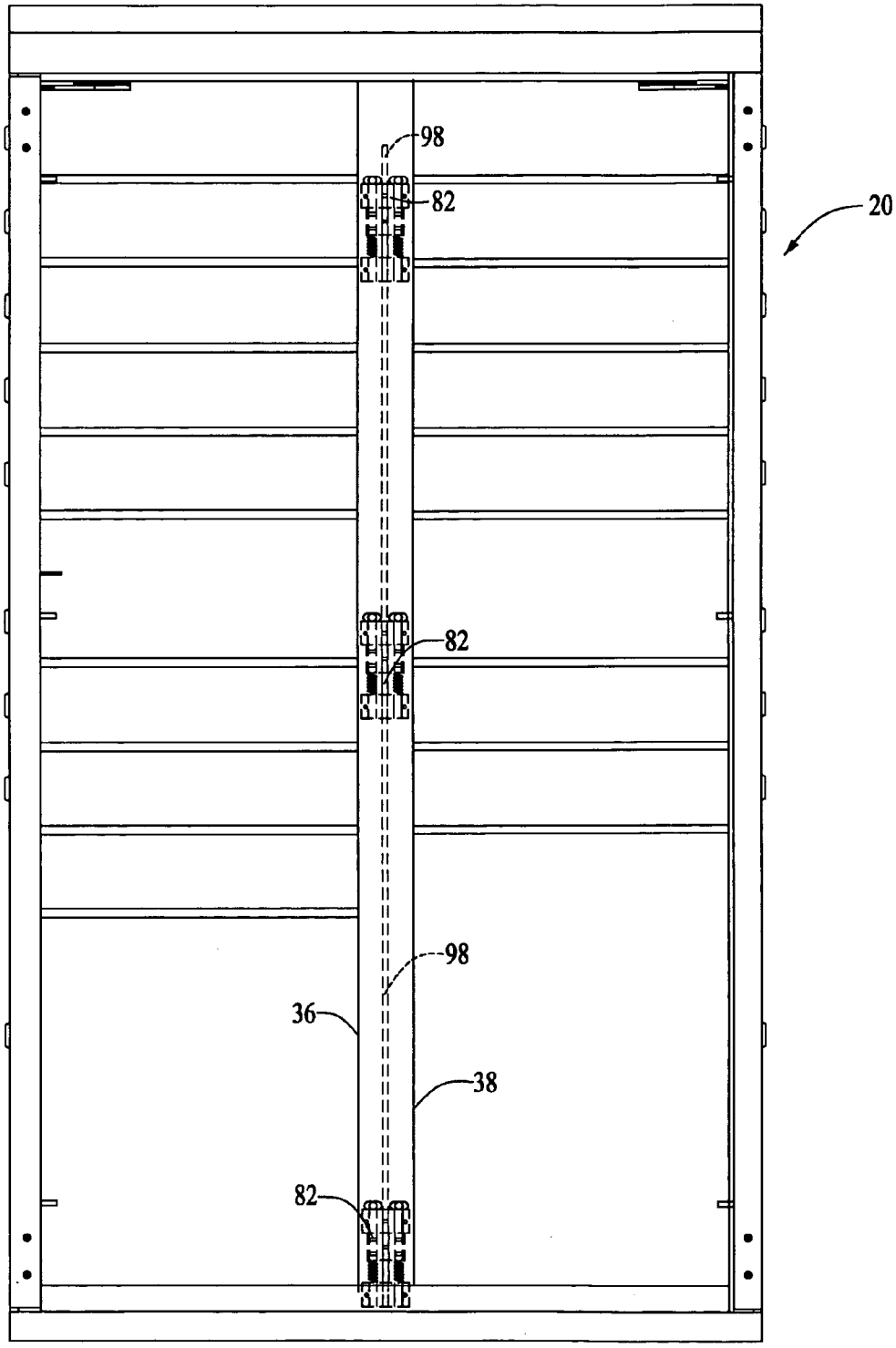
FIG. 11 is a front view of a typical postal box cluster unit with the front wall of the center channel removed to illustrate the position of the latch bolt mechanism between the left side panel and right side panel of the central partition.
Figure 13:
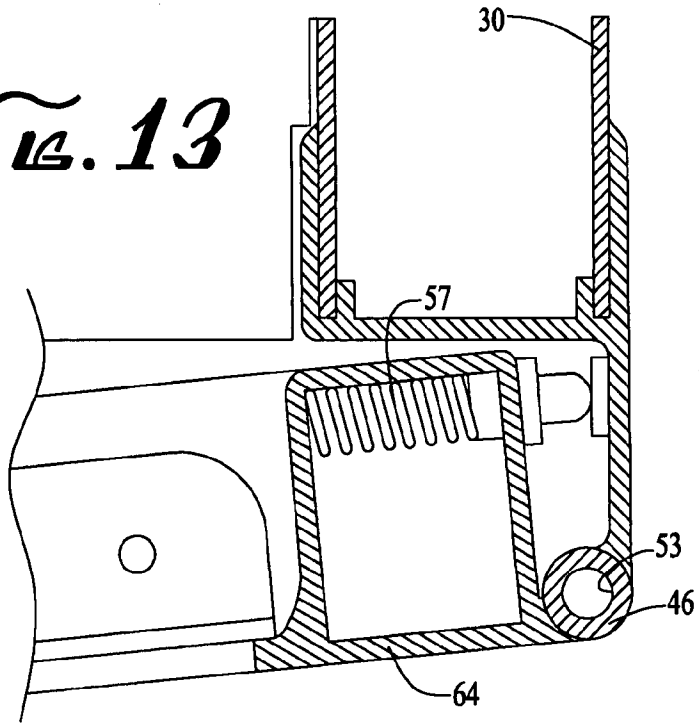
FIG. 13 is a top cross-sectional detail view of the right main door hinge assembly in a partially open position.
Figure 12:
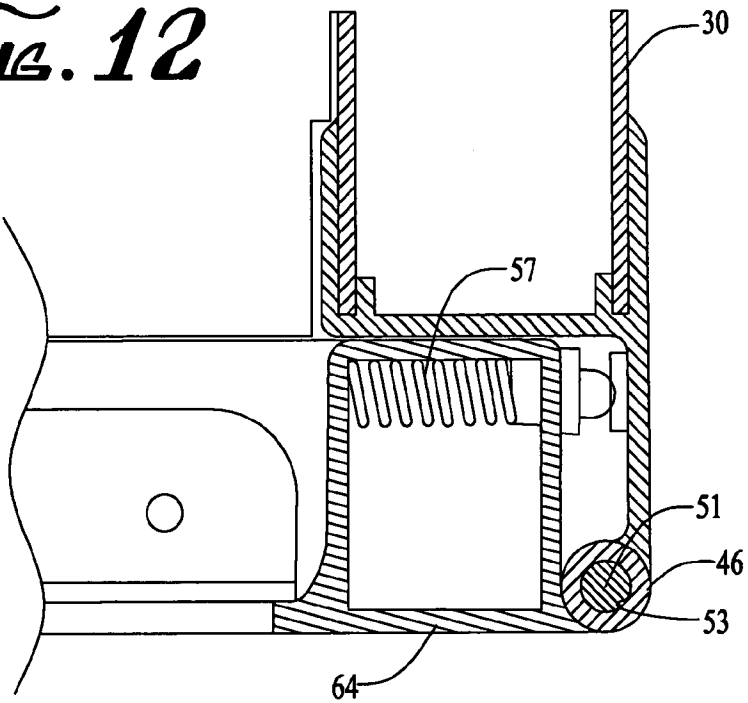
FIG. 12 is a top cross-sectional detail view of the right main door hinge assembly in the closed position.

With reference to FIGS. 1–13, a multiunit mailbox (20) including a latch assembly mechanism (10) and including door mounted elements and cabinet mounted elements preferably formed of an essentially rigid impact resistant and corrosion resistant material such as metal or a resilient high impact polymer will be described. The latch assembly (10) is positioned within a cabinet, mailbox or housing (20) having a top wall (22), bottom wall (24), back wall (26), left side wall (28), right side wall (30), a substantially planar front opening (32) and a central partition (34) extending from the back wall (26) toward the front opening (32) substantially between the top wall (22) and bottom wall (24). The central partition (34) includes a left side panel (36), a right side panel (38) and a front channel member (40) joining the side panels (36), (38). The housing or cabinet (20) is preferably fabricated of metal or other material having strength and rigidity sufficient to function as a mailbox.

The front opening (32) is rotatably covered by a left main door (42) and a right main door (44) supported, respectively, on side walls (28) and (30) of housing (20) by hinges (46). Each of the main doors (42), (44), respectively, includes a frame (49), (48) having a top frame member (50), (52), and a bottom frame member (54), (56). Left main door (42) includes a left side frame member (58) and a right side frame member (60). Right main door (44) includes a left side frame member (62) and a right side frame member (64). Hinge members (45) of hinge (46) are formed in or affixed to the left side frame member (58) of left main door (42), and are formed in or affixed to the right side frame member (64) of right main door (44). Hinge members (55) complementary to hinge members (45) are formed in or affixed to side walls (28), (30). Hinge members (45), (55) each have a central longitudinal bore (53). are rotatably engaged in fashion with the hinge members (46) formed in or affixed to the side frame members (58), (64), respectively, of main doors (42), (44). Each complementary engaged hinge member (45), (55) is rotateable with respect to the other about a hinge pin (51) extending through their respective coaxially aligned bores (53). Hinges (46) are operable to permit both main doors (42), (44) to lie in substantially the same plane to substantially cover or close front opening (32) with frame members (60) and (62) juxtaposed adjacently. Hinges (46) permit the main doors (42), (44) to each swing through an arc of at least 90 degrees to provide access to front opening (32). Further, doors (42), (44), or alternatively, side walls (28),(30), preferably include a conventional spring-loaded opening mechanism (57) that will urge doors (42), (44) to swing open upon release of the latch assembly mechanism (10).

With reference to FIGS. 1–13, central partition (34) includes channel (40) including a front wall (47). At predetermined positions between top wall (22) and bottom wall (24), a plurality of dual latch bolt subassemblies (82) are affixed to and within channel (40) and substantially enclosed within central partition (34). One embodiment of the present invention embodies three latch bolt subassemblies (82) similarly affixed in channel (40), with one near the upper end (41) of channel (40) proximate top wall (22), one near the lower end (43) of channel (40) proximate bottom wall (24) and one about midway between the ends (41), (43) of channel (40). It will be evident to one of skill in the art that the number of latching assemblies used and their positioning may differ from that described for the embodiment illustrated, for example in FIG. 3. Each latch bolt subassembly (82) includes an bolt upper guide (84) and a bolt lower guide (86), each of which is fixedly mounted in channel (40), and each of which has a pair of spaced apart parallel bolt bores (88). The bolt bores (88) of the bolt upper guide (84) and the bolt lower guide (86) of each subassembly (82) are coaxially aligned and cooperate to slidingly retain each of a pair of linear latch bolts (90) of predetermined length defining a longitudinal axis. Between each latch bolt upper guide (84) and latch bolt lower guide (86), a linking bracket (94) is affixed to each pair of latch bolts (90), so that movement of one bolt of the pair will cause the other bolt of the pair to move in the same direction for the same distance. The latch bolts (90) are restrained to a predetermined range of translational travel along bolt guides (84), (86) by conventional means such as, for example, by physical contact between a portion of the slidable bolt and a nonmovable portion of the assembly (82), or by interfering contact between the linking bracket (94) and a portion of channel (40). Around each latch bolt (90) a bolt coil spring (96) is disposed and is adapted to slide upon the bolt (90) whether in an extended or compressed configuration. For ease of manufacture, latch bolts (90) preferably have a circular cross-section, although any cross-section useful during operation as described may be used. Each coil spring (96) is positioned along and retained on each bolt (90) between the lower guide (86) and the linking bracket (94). Thus, movement of the linking bracket (94) toward the lower guide (86) causes the pair of latch bolts (90) of a subassembly (82) to move in the same direction and to compress or deform coil springs (96) to store potential energy of deformation in the springs (96) capable of providing an oppositely directed restoring force.

With reference to FIGS. 1, 6–8, 10 and 11, a substantially rigid actuator shaft or member (98) is fixed to and extends between the linking bracket (94) of the subassembly (82) to which the handle assembly (92) is mounted and the linking bracket (94) of the subassembly (82) mounted more proximate to the top wall (22). The actuator shaft or member (98) also is fixed to and extends between the linking bracket (94) of the subassembly (82) to which the handle assembly (92) is mounted and the linking bracket (94) of the subassembly (82) mounted more proximate to the bottom wall (24). The actuator shaft or member (98) is affixed to each linking bracket (94) at a position preferably between the pair of parallel bolts (90). As will now be clear, the coil springs (96) bias the latch bolts (90) to move in the direction from the lower guide (86) toward the upper guide (84), and to be at rest when coil springs (96) are least compressed with bolts (90) at the maximum of allowed travel in that direction. As will also now be clear, movement of the linking bracket (94) and attached dual latch bolts (90) of the middle subassembly (82) will cause a corresponding equal movement of the linking brackets (94) and attached dual latch bolts (90) of both the upper and lower subassemblies (82) by means of actuator shaft or member (98) affixed between linking brackets (94).

With continued reference to FIGS. 1, 6–8, 10 and 11, each latch bolt (90) is disposed such that a first end portion (91) of predetermined length extends beyond the first end surface (85) of upper guide (84) when bolt (90) is at the maximum extent of allowed travel and spring (96) is least compressed or deformed. First end surface (85) is located at the opposite end of guide (84) from the end of guide (84) proximate to where linking bracket (94) is attached to the bolt (90). First end portion (91) includes a cam surface (99) that preferably is convexly curved or rounded, but in various embodiments that may be a flat surface disposed at an angle with respect to the longitudinal axis of the bolt (90).

With reference to FIGS. 1–13, a latch port (100) is formed through channel front wall (47) adjacent the at rest position of each latch bolt cam surface (99) of each subassembly (82). A plurality of latch arms (102), corresponding to the number of subassemblies (82), are fixedly disposed on right side frame member (60) of left main door (42) and on left side frame member (62) of right main door (44). A latch arm (102) defines a latch arm aperture (104) adapted to admit first end portion (91) of latch bolt (90) and having an axis parallel with the longitudinal axis of a corresponding latch bolt (90). Latch arms (102) extend outward from frame members (60), (62) such that when doors (42), (44) are fully closed to cover front opening (32) of housing (20), a predetermined portion of each latch arm (102) extends through a corresponding latch port (100) formed through the front wall (47) of channel (40). Latch arms (102) and latch ports (100) are positioned such that each latch arm (102) will contact the cam surface (99) of a corresponding latch bolt (90) as a main door (42), (44) is closed. As a door (42), (44) is moved further toward a closed position, each latch arm (102) slidingly bears upon the cam surface (99) of a corresponding latch bolt (90) causing the bolt to move longitudinally to compress coil spring (96). As a door (42), (44) is moved still further toward a closed position latch arm apertures (104) and latch bolts (90) become coaxially aligned and latch bolts (90) urged by the restoring force of springs (96) move into and are captured in corresponding apertures (104) thereby latching the door (42), (44) in a closed position until released. When doors (42), (44) are closed and latched, door frame members (60), (62) interface with front wall (47) and cover plate (65) of frame member (62) bridges and covers the space or gap between frame members (60), (62) to resist insertion of tools or other objects into the gap.

With reference to FIGS. 1–13, the main doors (42), (44) each include a parcel locker door panel (68), (70), respectively, and smaller tenant door panels (71) that together cover the area enclosed and defined by frame members (50), (58), (54), (60) and (52), (62), (56), (64), respectively. Preferably, main doors (42), (44) include at least one lockable hinged access door (72) that overlays access door opening (74). When doors (42), (44) are in a closed position, hinged access door (72) and access door opening (74) are disposed to overlay a correspondingly sized and positioned cavity formed in cabinet (20). Access door opening (74) provides access to a handle opening (93) formed in a side panel (36), (38) of central partition (34). Handle opening (93) provides access to handle assembly (92) for manual operation. Handle assembly (92) is disposed within central partition (34) between side panels (36), (38) and between back wall (26) and channel (40), and is affixed to the linking bracket (94) of subassembly (82). Where a plurality of subassemblies (82) is utilized as described above, as is preferred, the handle assembly (92) is preferably affixed to the linking bracket (94) of the subassembly (82) mounted about midway between the ends (41), (43) of channel (40).

With reference to FIGS. 3 and 5–8, handle assembly (92) is operated to unlatch the latch assembly mechanism (10) by pushing handle paddle (95) to translate the handle assembly (92) and the attached linking brackets (94), actuator shaft or members (98) and sets of dual latch bolts (90) linearly downward, in a direction from top wall (22) toward bottom wall (24), until the latch bolts (90) are extracted from latch arm apertures (104) and drawn clear of latch arms (102). Once the latch bolts (90) are clear of latch arms (102), the latch arms (102) are withdrawn from latch ports (100) by rotation of main doors (42), (44) urged by a spring-loaded actuator or mechanism disposed adjacent the hinges (46).

While the present invention has been described in connection with what are presently considered to be the most practical and preferred embodiments, it is to be understood that the invention is not to be limited to the disclosed embodiments, but to the contrary, is intended to cover various modifications and equivalent arrangements included within the spirit of the invention, which are set forth in the appended claims, and which scope is to be accorded the broadest interpretation so as to encompass all such modifications and equivalent structures.

What is claimed is:

1. A multiunit mailbox comprising:

a housing having a front opening, a first side wall and a second side wall;

a first main door extending vertically along the front opening and rotatably mounted to the first side wall;

a second main door extending vertically along the front opening and rotatably mounted to the second side wall;

a cover plate integral with the second main door, extending vertically along the second main door and extending horizontally a length sufficient to overlay a portion of the first main door;

a channel mounted in the housing extending vertically along the front opening and having a substantially planar front wall penetrated by at least one latch port adapted to admit a latch arm;

at least one side panel affixed to said channel, extending substantially perpendicular to said front wall and not intersecting the plane of said front wall;

at least one guide affixed to said channel;

at least one latch bolt defining a longitudinal axis slidingly retained by said guide;

said latch bolt having a first end portion including a cam surface;

said latch bolt biased by a spring to position said first end portion in substantial alignment with said latch port;

said latch arm movable relative to said channel;

said latch arm movable to sequentially enter said latch port and to then slidingly contact said cam surface to urge said latch bolt to slide along said guide to deform said spring;

a latch arm aperture formed in said latch arm, having a central axis and adapted to receive and releasably retain said first end portion;

said latch arm aperture and said latch bolt disposed to substantially achieve coaxial alignment upon insertion of said latch arm a predetermined distance through said latch port resulting in said spring urging said first end portion to enter and be retained in said latch arm aperture until released;

a handle affixed to said latch bolt extending from said latch bolt in a direction substantially parallel with said side panel;

a handle opening formed in said side panel adjacent said handle to provide access for operation of said handle; and said handle operative to slide said latch bolt along said guide to withdraw said first end portion from said latch arm aperture to disengage said latch bolt from said latch arm and to allow said latch arm to be removed from said latch port.

2. A multiunit mailbox comprising:

a housing having a front opening a first side wall and a second side wall;

a first main door extending vertically along the front opening and rotatably mounted to the first side wall;

a second main door extending vertically along the front opening and rotatably mounted to the second side wall;

a cover plate integral with the second main door, extending vertically along the second main door and extending horizontally a length sufficient to overlay a portion of the first main door;

a channel mounted in the housing extending vertically along the front opening and having an upper end and a lower end and a substantially planar front wall;

said front wall penetrated by at least one pair of latch ports each adapted to admit a latch arm;

a pair of bolt upper guides affixed to said channel in abreast spaced apart relation a predetermined distance from said upper end;

a pair of bolt lower guides affixed to said channel in abreast spaced apart relation a predetermined distance from said upper end greater than the predetermined distance of said pair of bolt upper guides;

said pair of bolt upper guides and said pair of bolt lower guides disposed in tandem relation;

a pair of parallel latch bolts each extending through one of said pair of bolt upper guides and one of said pair of bolt lower guides and slidingly retained by said bolt upper guides and said bolt lower guides;

a linking bracket connecting said pair of latch bolts and affixed to said latch bolts between said tandemly disposed bolt upper guides and bolt lower guides;

a handle assembly affixed to said linking bracket;

a coil spring slidingly disposed on each said latch bolt between said linking bracket and said lower bolt guide to urge each said latch bolt in the direction toward said upper end;

each said latch bolt having a first end portion including a cam surface and extending a predetermined distance beyond each said bolt upper guide toward said upper end and urged by each said coil spring;

said pair of latch bolts each biased by said coil spring to position said first end portion in substantial alignment with one of the pair of latch ports;

a pair of said latch arms each independently movable with respect to said channel;

each of said pair of latch arms movable to sequentially enter one of said pair of latch ports and to then slidingly contact said cam surface to urge said pair of latch bolts to slide along said pair of upper bolt guides and said pair of lower bolt guides to deform each said coil spring and to increase the potential energy stored in said coil springs;

a latch arm aperture formed in each of said pair of latch arms and adapted to receive and releasably retain said first end portion;

each said latch arm aperture adapted to substantially align with said latch bolt upon insertion of said latch arm a predetermined distance through said latch port resulting in said pair of coil springs urging said first end portion of one of said pair of latch bolts to enter and be engaged in said latch arm aperture until released;

at least one side panel affixed to said channel, extending substantially perpendicular to said front wall and not intersecting the plane of said front wall;

said handle assembly extending from said linking bracket in a direction substantially parallel with said side panel and away from said front wall;

a handle opening formed in said side panel adjacent said handle assembly to provide access for operation of said handle assembly;

said handle assembly operative to slide said pair of latch bolts within said pair of bolt upper guides and said pair of bolt lower guides in the direction toward said lower end to draw said first end portion of each said pair of latch bolts within each said pair of bolt upper guides to disengage each engaged latch arm from said first disengaged portion and to allow each latch arm to be removed from said latch port.

3. The multiunit mailbox of claim 2 further including:

a plurality of pairs of said bolt upper guides affixed to said channel in abreast spaced apart relation;

each of said plurality of pairs of bolt upper guides disposed a different predetermined distance from said upper end;

a corresponding plurality of pairs of said bolt lower guides affixed to said channel in abreast spaced apart relation;

each of said corresponding plurality of pairs of bolt lower guides disposed a different a predetermined distance from said upper end greater than the predetermined distance of the pair of bolt upper guides which slidingly retain the same pair of latch bolts as does said pair of bolt lower guides;

an actuator member affixed to and interconnecting each of a corresponding plurality of pairs of said latch bolts;

said actuator member affixed to said handle assembly and responsive to movement of said handle assembly;

said handle assembly is operative to simultaneously draw the first end portion of each said plurality of pairs of latch bolts within each corresponding plurality of said pairs of bolt upper guides.

* * * * *